United States Patent [19]

Hanfeld

[11] 4,254,578

[45] Mar. 10, 1981

[54] TREE STAND

[76] Inventor: Franzhermann Hanfeld, Am Teeberg 90,, D-3111 Gerdau, Fed. Rep. of Germany

[21] Appl. No.: 903,674

[22] Filed: May 8, 1978

[51] Int. Cl.[3] ..... A47G 7/02

[52] U.S. Cl. ..... 47/40.5; 248/524

[58] Field of Search ..... 47/40.5, 39; 248/523, 248/524, 525, 526, 527, 528, 529, 511, 512, 513, 514, 516, 517, 518, 519, 520, 521, 522; D6/105

[56] References Cited

U.S. PATENT DOCUMENTS

| | | | |
|---|---|---|---|
| 283,392 | 8/1883 | Henneberg | 248/524 |
| 1,110,142 | 9/1914 | Piner | 248/524 |
| 1,505,357 | 8/1924 | Lindquist | 47/40.5 |
| 1,694,815 | 12/1928 | Garlick | 47/40.5 X |
| 1,732,284 | 10/1929 | Schulze | 248/523 |
| 1,873,471 | 8/1932 | Peterson | 248/524 |
| 2,476,225 | 7/1949 | Schroeder | 47/40.5 |
| 2,699,308 | 1/1955 | Shackelford | 248/524 |
| 2,755,050 | 7/1956 | Ford | 248/524 |
| 3,136,514 | 6/1964 | Rzepela | 47/40.5 |
| 3,295,802 | 1/1967 | Leatherman | 248/523 |
| 3,350,043 | 10/1967 | Apple | 47/40.5 |
| 3,591,114 | 7/1971 | Beatty | 47/40.5 |
| 3,697,026 | 10/1972 | Hambrick | 47/40.5 |
| 4,006,560 | 2/1977 | Schulz | 47/40.5 |

FOREIGN PATENT DOCUMENTS

| | | | |
|---|---|---|---|
| 151361 | 5/1904 | Fed. Rep. of Germany | 248/519 |
| 743053 | 12/1943 | Fed. Rep. of Germany | 47/248 |
| 1885019 | 12/1963 | Fed. Rep. of Germany | 47/248 |
| 1936185 | 4/1966 | Fed. Rep. of Germany | 47/248 |
| 2650973 | 5/1978 | Fed. Rep. of Germany | 47/40.5 |
| 79361 | 1/1934 | Sweden | 248/524 |

*Primary Examiner*—Edgar S. Burr
*Assistant Examiner*—James R. Feyrer
*Attorney, Agent, or Firm*—Spencer & Kaye

[57] ABSTRACT

A tree stand comprises a rigid base; a plurality of resilient bars each having a bend and a first portion extending substantially vertically downwardly from the bend and terminating in a free end. The first bar portions are arranged in a circular array and together define a generally cylindrical shaft for receiving the trunk of a tree and holding the same by a resilient clamping force. Each resilient bar further has a second portion extending from the respective bend obliquely downwardly and away from the shaft and is affixed to the base.

10 Claims, 6 Drawing Figures

TREE STAND

BACKGROUND OF THE INVENTION

This invention relates to a Christmas tree stand.

For supporting Christmas trees, stands are known which have a rigid frame into which the tree trunk is inserted and which include screws for clamping the trunk to the stand to form therewith a rigid unit. Such Christmas tree stands are available in a great number of varieties. For eliminating the screws, U.S. Pat. No. 1,732,284 discloses a Christmas tree stand having a rigid, bent sheet metal frame which includes an upper rigid ring for surrounding the tree trunk and several, freely suspended flat springs mounted on the ring in such an orientation that they are deformed outwardly by the inserted trunk. The springs, however, are too short for holding and centering trunks of irregular shape and different diameters. A Christmas tree stand of this structure thus has proved to be impractical.

SUMMARY OF THE INVENTION

It is an object of the invention to provide an improved Christmas tree stand which, despite its relatively small structural dimensions, is capable of receiving trunks of different diameters and is adapted to center the trees even if the trunk has an irregular outer surface.

This object and others to become apparent as the specification progresses, are accomplished by the invention, according to which, briefly stated, the tree stand comprises a rigid base; a plurality of resilient bars each having a bend and a first portion extending substantially vertically downwardly from the bend and terminating in a free end. The first bar portions are arranged in a circular array and together define a generally cylindrical shaft for receiving the trunk of a tree and holding the same by a resilient clamping force. Each resilient bar further has a second portion extending from the respective bend obliquely downwardly and away from the shaft and is affixed to the base.

DESCRIPTION OF THE PREFERRED EMBODIMENTS

Figure 1:
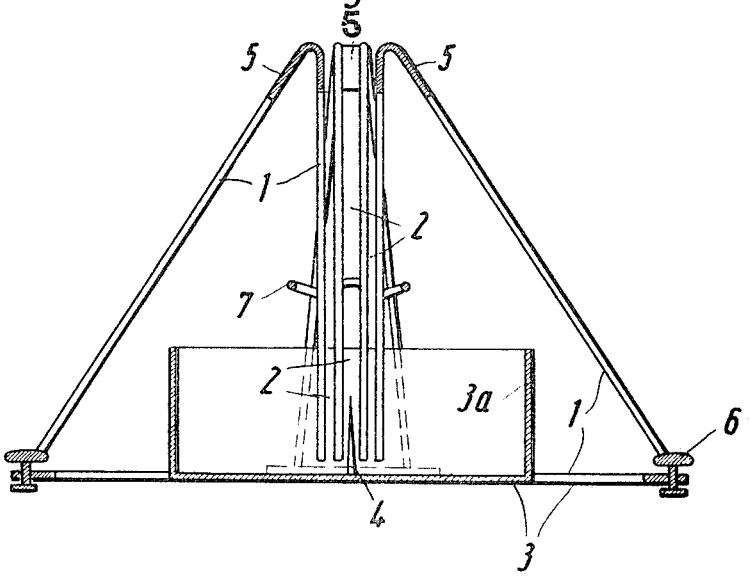
FIG. 1 is a sectional elevational view of a preferred embodiment of the invention.
Figure 2:
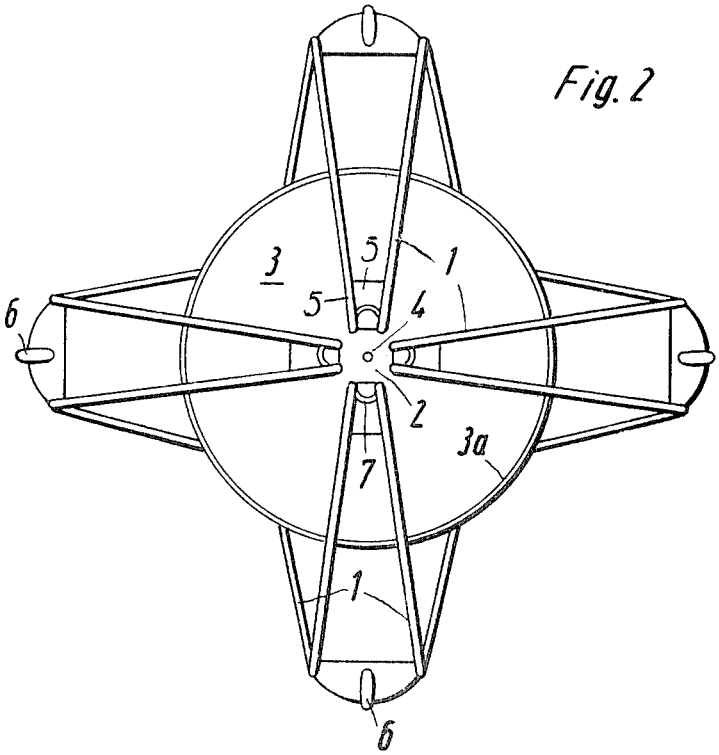
FIG. 2 is a top plan view of the same embodiment.

Turning now to FIGS. 1 and 2, the Christmas tree stand shown therein comprises a plurality of bent bars 1 which are made of a resilient material such as round or flat steel and which are arranged in a circular array. The bars 1 have a vertically orientated free end portion which together form a generally vertically oriented, cylindrical shaft 2 for concentrically surrounding the inserted Christmas tree trunk (not shown). At their other end, the bars 1 are affixed to a rigid base 3. Thus, as viewed from their lower free end, the bars 1 extend upwardly in a vertical orientation, then, after a bend at the top, extend obliquely downwardly to the base 3.

The circumferentially arranged vertical end portions of the bars 1 can be spread radially outwardly, so that the shaft 2 can be adapted to the thickness of the particular tree trunk to be supported. The larger the diameter of the trunk, the greater the pressure exerted by the bars on the trunk. This pressure is derived from the resilient force urging the bars 1 back into their normal position. In order to prevent the trunk from moving laterally in the lower zone of the shaft 2, the base 3 carries a vertically upwardly oriented spike 4 which is aligned with the axis of the shaft 2 and which penetrates into the end face of the inserted trunk and thus ensures that the tree and the stand form a rigid unit. The clamping force of the bars 1 is enhanced by reinforcements 5 which are provided at the upper and/or lower bends of the bars 1. There are further provided adjusting devices 6 at the outside of the base 3 for a subsequent setting of the vertical position of the supported tree. The vertical end portions of the bars 1 which define the shaft 2 are provided with handles 7 to facilitate a manual radial spreading of the shaft 2 during the insertion or removal of the tree.

The spring force exerted by the Christmas tree stand described above is not generated solely by the spring effect of the vertically oriented free end portions of the bars 2. Rather, the bar portions leading to the base 3 contribute significantly to the spring force and thus make possible an adaptation of the shaft width to varying trunk diameters, while the structural height of the stand can be maintained relatively small. Also, the obliquely extending parts of the bars 1 form such an angle with the inserted trunk that in case of a tendency to topple, the force exerted by the trunk on the obliquely extending parts of the bars 1 lies in the direction of these bar parts and thus spreads the shaft portions to a lesser extent than what would correspond to the absolute value of the force exerted by the trunk. Upon insertion or removal of the trunk, the obliquely extending bar portions are bent outwardly. In case the trunk is not yet inserted into the shaft, such an outward bending causes the vertically oriented end portions of the bars 1 to move into that zone of the shaft 2 which is subsequently occupied by the trunk. These parts of the shaft 2 have to be separately bent outwardly when the trunk is inserted into the stand. As a result, the spring forces have an effect both in the upper and in the lower zones of the shaft. This effect is further enhanced by the reinforcements 5 at the bends of the bars.

It is particularly well seen in FIG. 2 how the plurality of bars 1 are assembled to define the shaft 2 which may be formed of two or more parts. In FIG. 2 there is illustrated a four-part design; the vertically oriented end portions of the bars 1 are interconnected in pairs by means of the handles 7. This arrangement ensures that the trunk is prevented from slipping through the clearance between two bars.

For stability, the base 3 has a dish-shaped design. By forming the base as a watertight pot 3*a*, a watering of the tree in the stand is feasible. The vertically oriented parts of the bars 1 forming the shaft 2 terminate with a clearance above the bottom of the pot 3*a*. According to a modification of the stand, the water pot 3*a* alone constitutes the base 3. In such a case, the components of the stand are secured to the outer wall of the water pot 3*a* which then at the same time constitutes the outer edge of the clamping system. The adjusting devices 6 then may be mounted on the lower edge of the pot.

Figure 1A:
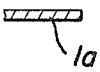
FIG. 1*a* is a sectional view of a component of a variant of the same embodiment.

The bars 1 may be made of round steel as shown in FIG. 1 or sheet metal as illustrated in FIG. 1*a* where the bar shown is designated at 1*a*. In the latter case the reinforcements 5 may be constitued by embossments provided in the bars at the bends.

Figure 3A:
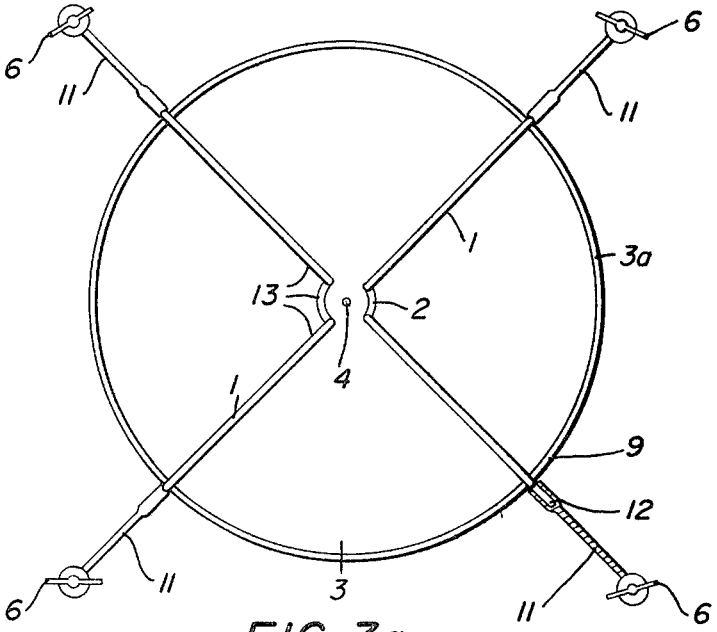
FIG. 3*a* is a top plan view of a further preferred embodiment.

In the case of round steel the reinforcements 5 may be constituted by webs as shown in FIGS. 1 and 2, or by flattening the upper and/or lower bends of bars 1 in a vertical direction. In order to maintain the height of the stand at a minimum without thereby adversely affecting its supporting stability, it may be of advantage to bend the bars 1 at the bottom side of the pot 3*a* so as to form radially outwardly directed horizontal bar ends 12. On the latter, as illustrated in FIG. 3*a* sleeves 11 may be inserted, the length of which corresponds to the desired supporting stability. One of such sleeves is shown in section in FIG. 3*a*. In case a rectangular shipping box is used for the stands, the radially outwardly extending bar ends may be of such a length that they project to the otherwise unutilized corners of the shipping box. The adjusting devices may be arranged either on the water pot as described above or they may be arranged at the ends of the insertable sleeves.

Figure 4:
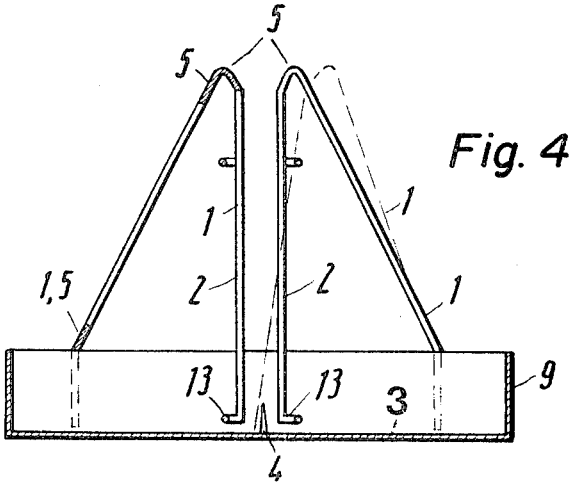
FIG. 4 is a sectional elevational view of the embodiment shown in FIG. 3.
Figure 3:
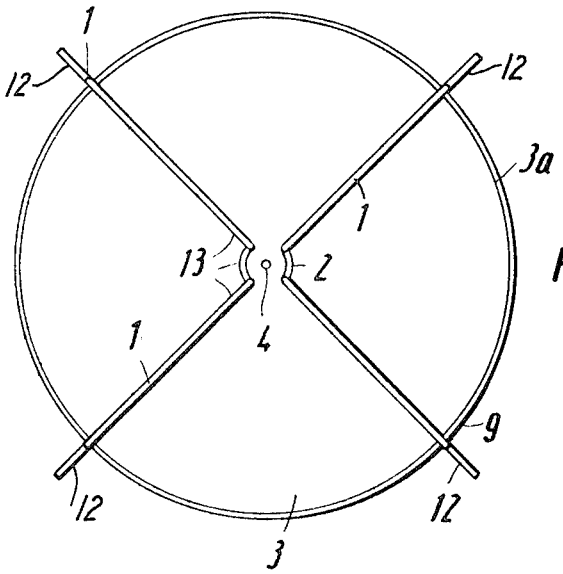
FIG. 3 is a top plan view of another preferred embodiment of the invention.

FIG. 4 is an elevational view of the Christmas tree stand described in connection with FIG. 3. In FIG. 4 there is shown in phantom lines the position of a bar 1 that had been pulled outwardly for enlarging the shaft 2. The vertically downwardly oriented bar portions of two adjoining bars 1 are connected to one another at their lower ends 13. In this manner, two adjoining bars 1 may be constituted of a one-piece bent member. Handles 7 may be provided additionally on the bars 1, but in this embodiment they need not serve as connecting components. The bar ends 13 are located with a clearance above the bottom of the pot 3*a*.

It will be understood that the above description of the present invention is susceptible to various modifications, changes and adaptations, and the same are intended to be comprehended within the meaning and range of equivalents of the appended claims.

What is claimed is:

1. A tree stand comprising (a) a pot; and (b) a plurality of resilient bars each having (1) a bend;

(2) a resilient first portion extending substantially vertically downwardly from said bend and terminating in a free end; the first portions of said bars extending substantially parallel to one another and being arranged in a circular array for forming together a generally cylindrical vertical shaft for receiving the trunk of a tree and holding the same by a resilient clamping force;

(3) a resilient second portion extending from said bend obliquely downwardly and away from said shaft and being affixed to said pot at a location remote from said bend; and (4) a third portion constituting a continuation of the second bar portion and extending radially outwardly in a horizontal direction from said pot for increasing the stability of the stand.

2. A tree stand as defined in claim 1, wherein said shaft has an axis; further comprising a vertically upwardly oriented spike affixed to said base and aligned with said axis.

3. A tree stand as defined in claim 1, further comprising reinforcements provided in said bars at the bends thereof.

4. A tree stand as defined in claim 3, wherein said reinforcements are embossments.

5. A tree stand as defined in claim 1, further comprising handles attached to the first portions of said bars.

6. A tree stand as defined in claim 1, wherein said bars are sheet metal members.

7. A tree stand as defined in claim 1, wherein said bars are connected to one another in pairs at the first portions thereof.

8. A tree stand as defined in claim 1, wherein said pot has an outer edge and wherein said bars are affixed to said outer edge at said remote location.

9. A tree stand as defined in claim 1, further comprising an extension removably attached to said third portion.

10. A tree stand as defined in claim 9, wherein said extension has a sleeve part insertable on said third portion.

* * * * *